US008929575B2

(12) United States Patent
Norris

(10) Patent No.: US 8,929,575 B2
(45) Date of Patent: Jan. 6, 2015

(54) HEARING ENHANCEMENT SYSTEMS AND METHODS

(71) Applicant: Parametric Sound Corporation, Poway, CA (US)

(72) Inventor: Elwood Grant Norris, Poway, CA (US)

(73) Assignee: Turtle Beach Corporation, Poway, CA (US)

( * ) Notice: Subject to any disclaimer, the term of this patent is extended or adjusted under 35 U.S.C. 154(b) by 0 days.

(21) Appl. No.: 13/789,491

(22) Filed: Mar. 7, 2013

(65) Prior Publication Data

US 2014/0254840 A1 Sep. 11, 2014

Related U.S. Application Data

(60) Provisional application No. 61/684,028, filed on Aug. 16, 2012.

(51) Int. Cl.
*H04R 25/00* (2006.01)
*H04R 29/00* (2006.01)

(52) U.S. Cl.
CPC ..... *H04R 25/50* (2013.01); *H04R 25/70* (2013.01); *H04R 2217/03* (2013.01)
USPC ..... 381/312; 381/60

(58) Field of Classification Search
USPC ..... 381/312–320, 23.1, 60, 151, 73.1; 600/25; 601/2; 607/55–57
See application file for complete search history.

(56) References Cited

U.S. PATENT DOCUMENTS

2002/0173697 A1* 11/2002 Lenhardt ..... 600/25
2005/0094822 A1 5/2005 Swartz
2005/0201574 A1* 9/2005 Lenhardt ..... 381/151
2010/0040249 A1 2/2010 Lenhardt

OTHER PUBLICATIONS

International Search Report and the Written Opinion of International App No. PCT/US2014/016551, mailed Jul. 22, 2014, Authorized Officer: De Jong, Coen.
Yang D; Bin Xu; Xu Wang; Xueqin Jia, The Study of Digital Ultrasonic Bone Conduction Hearing Device, IEEE Engineering in Medicine and Biology 27th Annual Conference, Shanghai, China, Sep. 1-4, 2005. pp. 1893-1896.

* cited by examiner

*Primary Examiner* — Curtis Kuntz
*Assistant Examiner* — Sunita Joshi
(74) *Attorney, Agent, or Firm* — Sheppard Mullin Richter & Hampton LLP

(57) ABSTRACT

Systems and methods for providing audio content and hearing-enhancement devices are provided. Systems and methods can be tailored to providing audio content to the hearing impaired, and can include evaluating a response profile of a listener; determining preferred ultrasonic signal parameters based on the listener's response profile; configuring an ultrasonic audio system according to the determined ultrasonic signal parameters; and using the ultrasonic audio system to transforming an audio signal into an ultrasonic pressure wave representing the audio signal.

37 Claims, 5 Drawing Sheets

*(BACKGROUND)*

HEARING ENHANCEMENT SYSTEMS AND METHODS

TECHNICAL FIELD

The present disclosure relates generally to listening devices, and some embodiments relate to parametric audio listening devices. More particularly, some embodiments relate to parametric audio systems and methods for hearing aids, assistive listening and other hearing-enhancement devices.

BACKGROUND

Hearing aid technology enjoys a long and colorful history. Early hearing aids used in the $18^{th}$ and $19^{th}$ centuries were often referred to as ear trumpets. They essentially consisted of a large horn, or bell, that tapered into a thinner tube for placement in or near the ear. They were large, bulky passive devices that simply increased the volume of sound and provided some noise filtering by directing the desired sound directly into the ear.

Around the turn of the $20^{th}$ century, electronic hearing aids began to enter the market. These were tabletop or desktop items that were cumbersome and impractical, but they provided electronic amplification of the desired sound. While desktop devices were reduced in size over the next few decades, they were still cumbersome units and their battery life was typically only a few hours. With reduction in the size of vacuum tubes, hearing aids shrunk to the point that they were considered "pocket-sized" or "wearable," but were still bulky and required large batteries.

With the advent of the transistor, the hearing aid shrunk dramatically. Indeed, the development of transistors in 1948 by Bell Laboratories allowed numerous improvements to be made to the hearing aid, including a dramatic reduction in size. Making use of the transistor and its decreasing dimensions, companies were able to introduce concealable hearing aids. These devices, sometimes referred to as behind-the-ear devices (BTEs), are still available today. Early examples of BTE devices introduced in the 1950's included the Beltone Slimette, the Zenith Diplomat and the Electone 600. With continued advancements in technology, the hearing aid continued to shrink in size to become in-the-ear and in-the-ear-canal devices. Today, some hearing aids are so small that they are implantable.

Conventionally, sound is produced by vibrations such as the movement of a speaker cone, the vibration of a piano string, or the vibration of human vocal cords. These vibrations result in an alternating compression and rarefaction of the air, creating a sound wave that propagates through the air. When produced at wavelengths corresponding to frequencies within the range of human hearing and at sufficient sound pressure levels, these disturbances in the air result in audible sound. The frequency of the resultant sound wave relates to the pitch of the sound, while the amplitude of the sound wave correlates to the loudness of the sound.

FIG. 1 is a block diagram generally representing the features of the mammalian ear. Sounds detected by a human subject reach the ear 101, travel through the external auditory meatus (i.e., the ear canal) 102, to the inner ear 111. The sound wave in the ear canal 102 causes a vibration in the tympanic membrane 103, or ear drum. This vibration is conveyed through the middle ear 104 by way of three small bones commonly referred to as the hammer, anvil and stirrup. The tympanic membrane 103 and the three small bones, or ossicles, carry the sound from the outer ear, through the middle ear to the inner ear. The inner ear includes a spiral-shaped cochlea 111, which is filled with a fluid that vibrates in response to vibrations of the ossicles. Particularly, vibration of the stirrup causes corresponding pressure changes in the fluid of the inner ear. Thus, motion of the stapes is converted into motion of the fluids of the cochlea 111, which some theorize results in a traveling wave moving along the basilar membrane 108.

These pressure changes result in oscillating movements of tiny hair cells, or stereocilia 109, in the inner ear. More particularly, vibrations of the basilar membrane 108 move the bodies of the hair cells 109, deflecting them in a shearing motion, transforming the mechanical energy of sound waves into electrical signals, ultimately leading to an excitation of the auditory nerve. Accordingly, the cochlea 111 converts the mechanical energy of the stapes into electrochemical impulses. These impulses are transmitted via the central auditory nervous system to the auditory processing centers of the brain.

Different sounds are believed to excite different hair cells at different points along what is known as the basilar membrane. The basilar membrane has cross striations, and it varies in width from the base to the apex of the cochlea. Accordingly, different portions of the basilar membrane vibrate at different frequencies. This, in turn, causes different sound frequencies to affect different groupings of the hair cells.

Some audible sound may also reach the inner ear through bone conduction. However, it has been shown that sound conduction through the outer and middle ear is the dominant mechanism for allowing audible sound waves to reach the inner ear and that creating waves with sufficient energy to carrier audio information to the inner ear requires inducement by direct mechanical vibration. Accordingly, sound waves arriving at the listener are predominantly captured by the outer ear and delivered through the hearing system to the inner ear. Sound waves in the range of 20-20,000 Hz are typically only heard through bone conduction when the sound has very high intensity and the listener's ear canals are blocked or audio is otherwise prevented from traveling through the outer and middle ear.

SUMMARY

Embodiments of the systems and methods described herein provide a HyperSonic Sound (HSS) audio system or other ultrasonic audio system for a variety of different applications. Certain embodiments provide ultrasonic audio in applications for the hearing impaired. Particularly, some embodiments of the systems and methods described herein provide for demodulation of an audio-encoded ultrasonic carrier signal within the listener's skull or within the listener's inner ear.

In some embodiments, a method for providing audio content to the hearing impaired, the method includes evaluating a hearing response profile of a listener to an audio modulated ultrasonic carrier signal; receiving audio content from an audio source; adjusting the audio content to at least partially compensate for the listener's hearing response profile; modulating the adjusted audio content onto an ultrasonic carrier signal to generate an equalized audio modulated ultrasonic carrier signal, and converting the equalized audio modulated ultrasonic carrier signal into an ultrasonic pressure wave representing the equalized audio modulated ultrasonic carrier signal; and wherein the ultrasonic pressure wave is demodulated in air, causing audio representing the adjusted audio content to be created.

In various embodiments, a response profile can be created by generating a plurality of audio tones using an ultrasonic audio system and recording the listener's response to the generated tones. The hearing response profile can indicate a frequency range at which the listener has a hearing disability and a quantified amount of hearing disability at that frequency range.

Adjusting the audio content can include adjusting the audio content to increase a pre-modulated energy level of the audio content at the indicated frequency by the quantified amount. Adjusting the audio content can also include adjusting the audio content to increase the de-modulated sound pressure level of the audio content at the indicated frequency by the quantified amount.

In another embodiment, a method for providing audio content to the hearing impaired includes evaluating a hearing response profile of a listener to audio modulated ultrasonic carrier signals; determining preferred ultrasonic signal parameters based on the listener's hearing response profile; receiving audio content from an audio source; adjusting the ultrasonic signal parameters based on the listener's hearing response profile; modulating the adjusted audio content onto an ultrasonic carrier signal to generate an equalized audio modulated ultrasonic carrier signal, and converting the equalized audio modulated ultrasonic carrier signal into an ultrasonic pressure wave representing the equalized audio modulated ultrasonic carrier signal; and wherein the ultrasonic pressure wave is demodulated in air, causing audio representing the adjusted audio content to be created. The listener's response profile can include determining which ultrasonic frequency of a range of ultrasonic frequencies provides the listener with the most improved hearing of audio content conducted by an ultrasonic carrier. The ultrasonic carrier can, in some embodiments, be set at a center frequency selected to optimize the listener's hearing of the audio resulting from the demodulation.

In further embodiments, a hearing-enhancement device, includes an ultrasonic audio system; the ultrasonic audio system comprising: input port configured to receive an electronic signal representing audio content; a mixer coupled to the input port and configured to combine the audio signal with an ultrasonic carrier signal; an amplifier having an input coupled to the mixer and an output, the amplifier configured to amplify the ultrasonic carrier signal; and an ultrasonic transducer having an input communicatively coupled to the output of the amplifier and being configured to generate a pressure wave representing the modulated ultrasonic carrier signal; wherein a signal parameter of the ultrasonic audio system is configured based on a response profile of an intended listener. The listener's response profile can be determined by determining which ultrasonic frequency of a range of ultrasonic frequencies provides the listener with the most improved hearing of audio content conducted by an ultrasonic carrier. The listener's response profile can also be determined by determining placement of an actuator used to deliver the ultrasonic pressure wave to the listener. The response profile of the intended listener can include a hearing profile and wherein configuring a signal parameter of the ultrasonic audio system can include equalizing the audio content in accordance with the listener's hearing profile. In various embodiments, the hearing-enhancement device can include a hearing aid or an assistive listening device.

In still further embodiments, a method for providing audio content to the hearing impaired includes evaluating a response profile of a listener; determining preferred ultrasonic signal parameters based on the listener's response profile; configuring an ultrasonic audio system according to the determined ultrasonic signal parameters; and using the ultrasonic audio system to transform an audio signal into an ultrasonic pressure wave representing the audio signal. Determining preferred ultrasonic signal parameters based on the listener's response profile can include determining which ultrasonic frequency of a range of ultrasonic frequencies provides the listener with the most improved hearing of audio content conducted by an ultrasonic carrier. Determining preferred ultrasonic signal parameters based on the listener's response profile can also include determining optimal placement of an actuator used to deliver the ultrasonic pressure wave to the listener.

Systems and methods described herein can also include causing the ultrasonic pressure wave to contact the head of a listener; wherein the ultrasonic pressure wave upon contact with the listener is conducted through one or more bones of the listener to the listener's inner ear, and wherein the ultrasonic pressure wave is demodulated in the listener's inner ear thereby recovering an audio pressure wave in the inner ear, the recovered audio pressure wave representing the audio content.

The systems and methods can further include causing the ultrasonic pressure wave to contact the head of a listener; wherein the ultrasonic pressure wave upon contact with the listener is conducted through one or more bones of the listener to the listener's inner ear, and wherein the ultrasonic pressure wave is demodulated in the listener's inner ear thereby recovering an audio pressure wave in the inner ear, the recovered audio pressure wave representing the audio content. Causing the ultrasonic pressure wave to contact the head of a listener can include launching the pressure wave into the air in a direction toward the listener. Causing the ultrasonic pressure wave to contact the head of a listener can also include launching the pressure wave from an actuator placed in contact with the listener's head. Causing the ultrasonic pressure wave to contact the head of a listener can also include launching the pressure wave from an actuator placed in contact with the listener's skull subcutaneously. The actuator may be placed in contact with the listener's temporal bone, mastoid process or parietal bone.

In still further embodiments, a method for providing audio content to the hearing impaired includes evaluating a response profile of a listener's head to ultrasonic signals; determining preferred ultrasonic signal parameters based on the listener's response profile; receiving from an audio source an electrical signal representing audio content; modulating the audio content onto an ultrasonic carrier to create an audio-modulated ultrasonic signal; amplifying the audio-modulated ultrasonic signal to create an amplified audio-modulated signal; transforming the amplified audio-modulated ultrasonic signal into an ultrasonic pressure wave representing the audio-modulated ultrasonic signal; and causing the ultrasonic pressure wave to be directed toward the listener. Causing the ultrasonic pressure wave to be directed toward the listener can include causing the ultrasonic pressure wave to contact the head of a listener; wherein the ultrasonic pressure wave upon contact with the listener is conducted through one or more bones of the listener to the listener's inner ear, and wherein the ultrasonic pressure wave is demodulated in the listener's inner ear thereby recovering an audio pressure wave in the inner ear, the recovered audio pressure wave representing the audio content. Determining preferred ultrasonic signal parameters based on the listener's response profile can include determining a hearing profile for the listener and determining an equalization for the audio content that is complementary to the listener's hearing profile.

BRIEF DESCRIPTION OF THE DRAWINGS

The disclosed technology, in accordance with one or more various embodiments, is described in detail with reference to the accompanying figures. The drawings are provided for purposes of illustration only and merely depict typical or example embodiments of the disclosed technology. These drawings are provided to facilitate the reader's understanding of the systems and methods described herein, and shall not be considered limiting of the breadth, scope, or applicability of the claims.

The figures are not intended to be exhaustive or to limit the disclosed technology to the precise form disclosed. It should be understood that the disclosed technology can be practiced with modification and alteration, and that the disclosed technology be limited only by the claims and the equivalents thereof.

DESCRIPTION

Embodiments of the systems and methods described herein provide an ultrasonic audio system for a variety of different applications. Certain embodiments provide ultrasonic audio in applications for the hearing impaired. Particularly, some embodiments of the systems and methods described herein provide for demodulation of an audio-encoded ultrasonic carrier signal within the listener's skull or within the listener's inner ear. According to various embodiments of the systems and methods described herein, audio information is captured for transmission to one or more listeners. The audio information can be various forms of audio content, including, but not limited to, a musical work, speech, audio content from a movie or television program, a live performance, and so on. The audio information may be pre-recorded or it may be live. Examples of pre-recorded audio information might include, without limitation, pre-recorded musical performances (e.g., musical albums, concerts, songs, operas, and other performances) the audio content associated with a video program, speeches, and so on. The pre-recorded content can be stored in memory, on a disk, in the cloud, on audio CDs and DVDs, and on various other mediums or platforms, and can be stored as MP3 files or other file types. Examples of live audio information can be a live performance of a play, show, musical or other theatrical event; a live speech, presentation or talk; church or worship services; a guided-tour presentation; or other live audio events or content.

Figure 2:
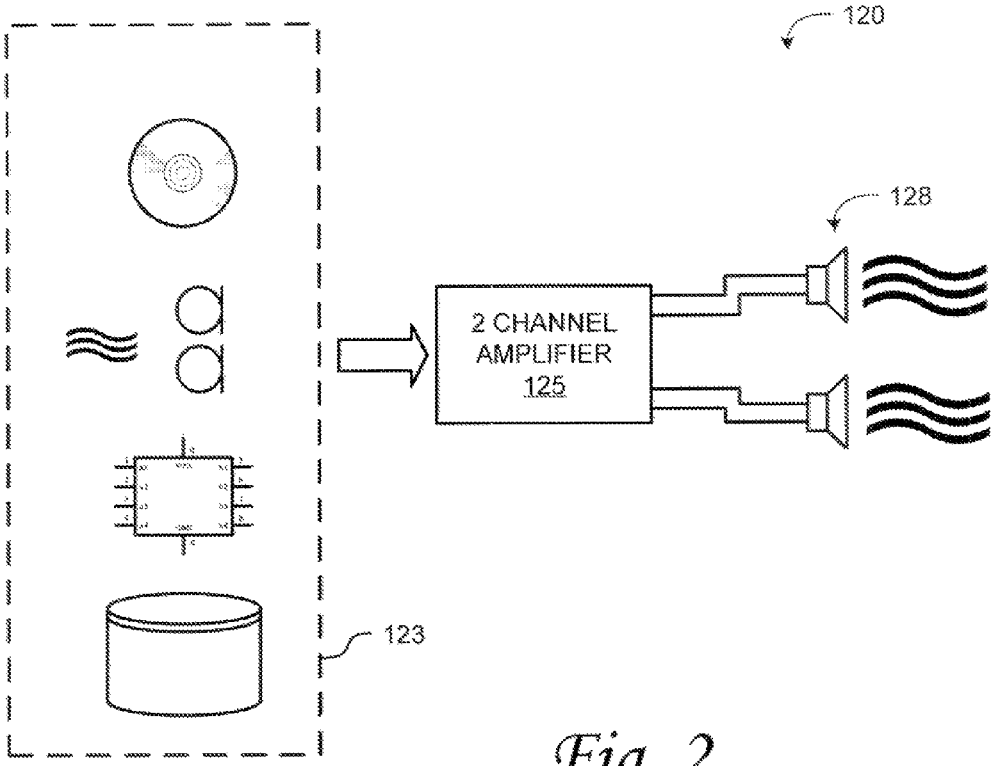
FIG. 2 is a diagram illustrating an example of a conventional audio sound system.

FIG. 2 is a diagram illustrating an example of a conventional audio sound system. In a conventional audio system 120, audio content from an audio source 123, such as, for example, a microphone or microphones, memory, a data storage device, streaming media source, CD, DVD or other audio source is received. The audio content may be decoded and converted from digital to analog form, depending on the source. The audio content is amplified by an amplifier 125 and played to the listener or listeners over conventional loudspeakers 128. The audio is delivered to the listener(s) in the form of sound waves, which are detectable by human ears.

Figure 3:
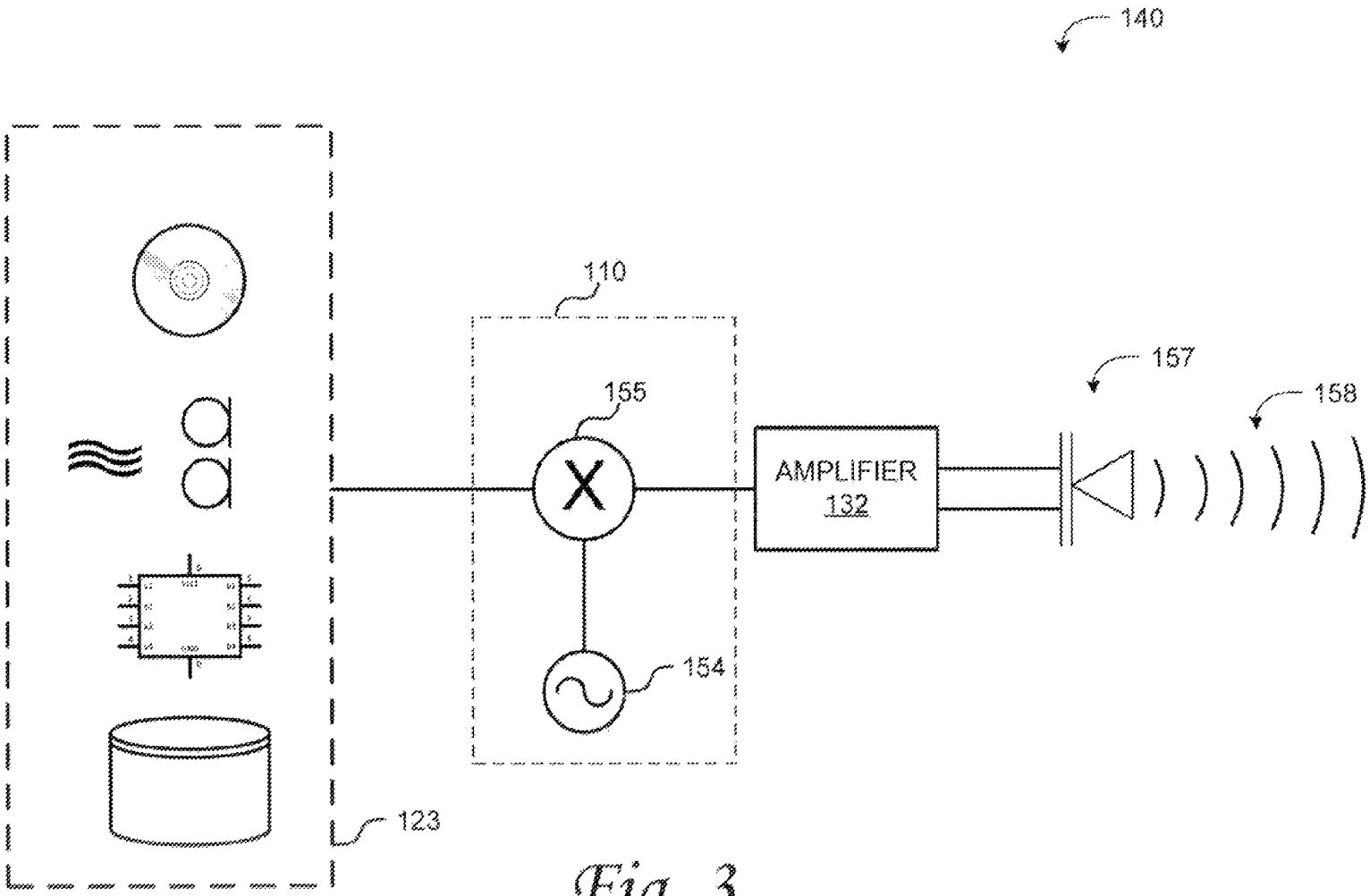
FIG. 3 is a diagram illustrating an ultrasonic sound system suitable for use with the systems and methods described herein.

FIG. 3 is a diagram illustrating an ultrasonic sound system suitable for use with the systems and methods described herein. In this exemplary ultrasonic system 140, the audio content received by the audio system is modulated onto an ultrasonic carrier of a predetermined frequency, at signal processing system 110. Processing system 110 typically includes a local oscillator 154 to generate the ultrasonic carrier signal, and multiplier 155 to multiply the audio signal by the carrier signal. The resultant signal is a double- or single-sideband signal 158 with a carrier at predetermined frequency. In some embodiments, signal 158 is a parametric ultrasonic wave or an HSS signal. In most cases, the modulation scheme used is amplitude modulation, or AM. AM can be achieved by multiplying the ultrasonic carrier by the information-carrying signal, which in this case is the audio signal. The spectrum of the modulated signal has two sidebands, an upper and a lower side band, which are symmetric with respect to the carrier frequency, and the carrier itself.

The modulated, amplified ultrasonic carrier signal is provided to the transducer 157, which launches the ultrasonic wave into the air creating ultrasonic wave 158. When played back through the transducer at a sufficiently high sound pressure level, due to nonlinear behavior of the air through which it is 'played' or transmitted, the carrier in the signal mixes with the sideband(s) to demodulate the signal and reproduce the audio content. This is sometimes referred to as self-demodulation. Thus, even for single-sideband implementations, the carrier is included with the launched signal so that self-demodulation can take place. Although the system illustrated in FIG. 3 uses a single transducer to launch a single channel of audio content, one of ordinary skill in the art after reading this description will understand how multiple mixers, amplifiers and transducers can be used to transmit multiple channels of audio using ultrasonic carriers.

Figure 4:
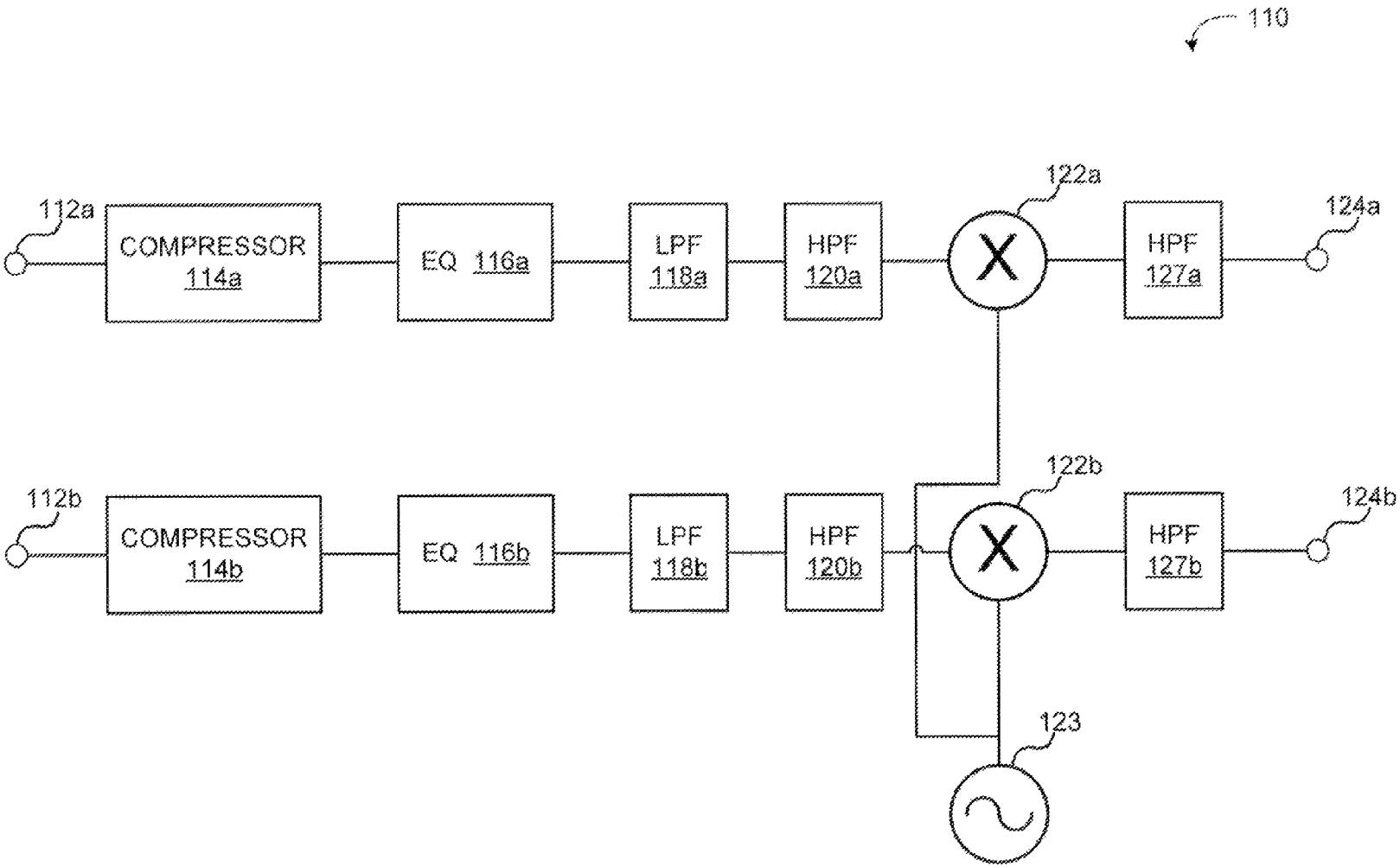
FIG. 4 is a diagram illustrating an example ultrasonic signal processing system suitable for use with the systems and methods described herein.

One example of a signal processing system 110 that is suitable for use with the technology described herein is illustrated schematically in FIG. 4. In this embodiment, various processing circuits or components are illustrated in the order (relative to the processing path of the signal) in which they are arranged according to one implementation. One or more of these processing circuits or components can be implemented using a digital signal processor or other processing module. It is to be understood that the components of the processing circuit can vary, as can the order in which the input signal is processed by each circuit or component. Also, depending upon the embodiment, the processing system 110 can include more or fewer components or circuits than those shown.

Also, the example shown in FIG. 4 is optimized for use in processing two input and output channels (e.g., a "stereo" signal), with various components or circuits including substantially matching components for each channel of the signal. It will be understood by one of ordinary skill in the art after reading this description that the audio system can be implemented using a single channel (e.g., a "monaural" or "mono" signal), two channels (as illustrated in FIG. 4), or a greater number of channels.

Referring now to FIG. 4, the example signal processing system 110 can include audio inputs that can correspond to left 112*a* and right 112*b* channels of an audio input signal. Compressor circuits 114*a*, 114*b* can be included to compress the dynamic range of the incoming signal, effectively raising the amplitude of certain portions of the incoming signals and lowering the amplitude of certain other portions of the incoming signals. More particularly, compressor circuits 114*a*, 114*b* can be included to narrow the range of audio amplitudes. In one aspect, the compressors lessen the peak-to-peak amplitude of the input signals by a ratio of not less than about 2:1.

Adjusting the input signals to a narrower range of amplitude can be done to minimize distortion, which is characteristic of the limited dynamic range of this class of modulation systems.

After the audio signals are compressed, equalizing networks 116*a*, 116*b* can be included to provide equalization of the signal. The equalization networks can, for example, boost or suppress predetermined frequencies or frequency ranges to increase the benefit provided naturally by the emitter/Inductor combination of the parametric emitter assembly.

Low pass filter circuits 118*a*, 118*b* can be included to provide a cutoff of high portions of the signal, and high pass filter circuits 120*a*, 120*b* providing a cutoff of low portions of the audio signals. In one exemplary embodiment, low pass filters 118*a*, 118*b* are used to cut signals higher than about 15-20 kHz, and high pass filters 120*a*, 120*b* are used to cut signals lower than about 20-200 Hz.

The high pass filters 120*a*, 120*b* can be configured to eliminate low frequencies that, after modulation, would result in deviation of carrier frequency. Also, some low frequencies are difficult for the system to reproduce efficiently and as a result, much energy can be wasted trying to reproduce these frequencies. Therefore, high pass filters 120*a*, 120*b* can be configured to cut out these frequencies.

The low pass filters 118*a*, 118*b* can be configured to eliminate higher frequencies that, after modulation, could result in the creation of an audible beat signal with the carrier. By way of example, if a low pass filter cuts frequencies above 15 kHz, and the carrier frequency is approximately 44 kHz, the difference signal will not be lower than around 29 kHz, which is still outside of the audible range for humans. However, if frequencies as high as 25 kHz were allowed to pass the filter circuit, the difference signal generated could be in the range of 19 kHz, which is within the range of human hearing.

In the example system 110, after passing through the low pass and high pass filters, the audio signals are modulated by modulators 122*a*, 122*b*. Modulators 122*a*, 122*b*, mix or combine the audio signals with a carrier signal generated by oscillator 123. For example, in some embodiments a single oscillator (which in one embodiment is driven at a selected frequency of 40 kHz to 50 kHz, which range corresponds to readily available crystals that can be used in the oscillator) is used to drive both modulators 122*a*, 122*b*. By utilizing a single oscillator for multiple modulators, an identical carrier frequency is provided to multiple channels being output at 124*a*, 124*b* from the modulators. Using the same carrier frequency for each channel lessens the risk that any audible beat frequencies may occur.

High-pass filters 127*a*, 127*b* can also be included after the modulation stage. High-pass filters 127*a*, 127*b* can be used to pass the modulated ultrasonic carrier signal and ensure that no audio frequencies enter the amplifier via outputs 124*a*, 124*b*. Accordingly, in some embodiments, high-pass filters 127*a*, 127*b* can be configured to filter out signals below about 25 kHz.

As described below, in some embodiments rather than launching the ultrasonic signal into the air toward the listener, an ultrasonic transducer or other actuator is positioned percutaneously or subcutaneously at the user's skull to induce the vibrations of the modulated ultrasonic carrier and sideband(s) directly to the listener's skull. Accordingly, in this and other applications, the ultrasonic system can be configured as a portable system to be worn or carried by the user.

In accordance with various embodiments of the systems and methods described herein, the ultrasonic audio system is optimized or otherwise configured to use the fluid in the inner ear, or the bones surrounding the ear, or a combination of the two as medium in which the carrier mixes with the sidebands to demodulate the signal near or within the ear. This can be in place of or in addition to self-demodulation in the air. Accordingly, with the use of a properly tuned HSS or other ultrasonic audio system, hearing can be improved.

In some embodiments, the audio system replaces or augments the conventional creation of electrical signals stimulated by vibration of the tympanic membrane. According to embodiments of the technology described herein, signal 158 is demodulated and the audible signal is generated in the air along the path of signal 158. This includes generation of audio content immediately at the listener's ears. Additionally, in some embodiments, an ultrasonic audio system such as the one shown in FIGS. 3 and 4 is configured to result in creation of the sound wave within or near the inner ear to enhance the creation of electrical signals that excite the auditory nerve. Particularly, the ultrasonic signal 158 can be conducted by the bones to the inner ear, and the signal 158 demodulated in the fluid in the inner ear.

The auricle, or pinna, is the visible portion of the human ear that can be seen protruding from the temporal lobe. It is made up primarily of skin and cartilage. The auricles help to collect sound and concentrate it at the eardrum. The auricles also assist the listener in localizing sound and determining from which direction the sound is originating. Once through the auricle, conventional sound waves enter the ear through the external auditory meatus, which is commonly referred to as the ear canal. The external auditory meatus is roughly cylindrical in shape, and directs the sound to the tympanic membrane.

The structure of the external auditory meatus creates resonance at certain frequencies, resulting in the generation of standing waves. Because the external auditory meatus is essentially a tube closed on one end by the tympanic membrane, basic physics can be used to calculate the resonance. The fundamental frequency ($f_1$) of a tube closed on one end is given by:

$$f_1 = v/(4l)$$

where v is the speed of sound in air and l is the length of the closed tube (i.e., the external auditory meatus).

Assuming the length of the external auditory meatus (l) is 2.3 cm or 0.023 m and the speed of sound in air (v) is approximately 343 m/s and substituting these values, the fundamental frequency, $f_1$, is approximated as:

$$f_1 = (343\ \text{m/s})/(4*0.023\ \text{m})$$

$$f_1 = 3728\ \text{Hz}$$

However, because the tympanic membrane at the end of the external auditory meatus both absorbs and reflects a part of the energy, it provides a damping effect. As a result, the resonant frequency range is actually broader, spanning a range from 3500 to 4000 Hz. Accordingly, the ear canal helps to amplify frequencies in this range. Signals outside of this range but still within the generally accepted range of human hearing of 20-20,000 Hz impinge upon and set up vibrations in the tympanic membrane, but are attenuated compared to those at the fundamental frequency. Ultrasonic signals suitable for use with the systems and methods described herein fall well outside the range of fundamental frequencies of the typical human ear canal. Accordingly, bone conduction of the ultrasonic signal can, in one embodiment, be used to carry the ultrasonic signal to the inner ear.

Figure 5:
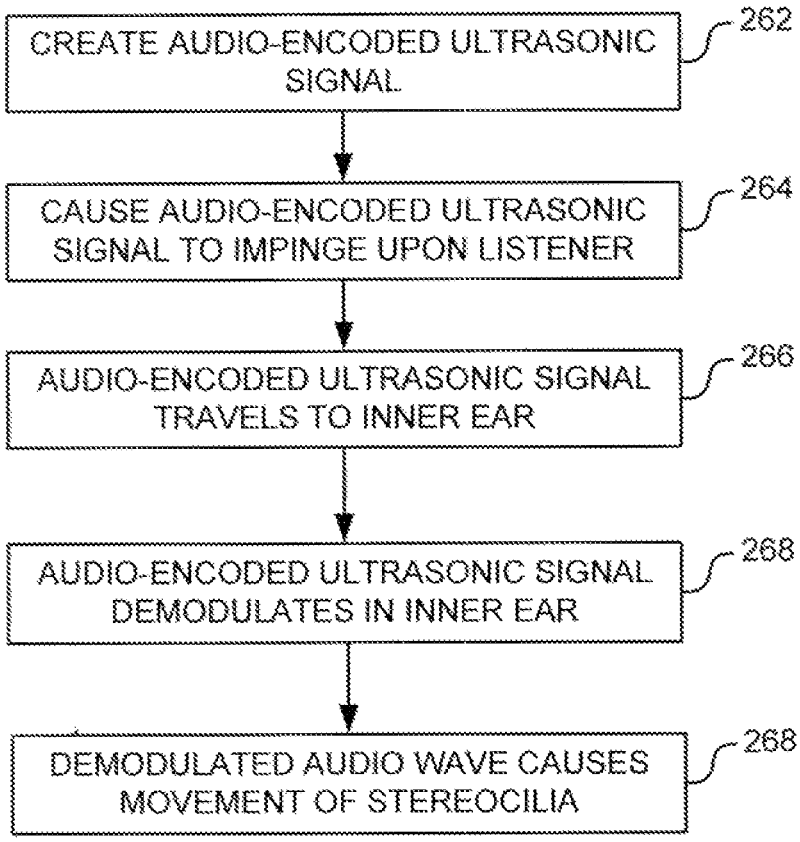
FIG. 5 is a diagram illustrating an example process in accordance with one embodiment of the systems and methods described herein.

FIG. 5 is a diagram illustrating an example process in accordance with one embodiment of the systems and methods described herein. Referring now to FIG. 5, at operation 262 an audio encoded ultrasonic signal is created. For example, in one embodiment the ultrasonic signal is created using a system such as that shown in and described with reference to FIG. 3, and tuned to enhance or optimize creation of the sound waves in the inner ear of the intended listener. The terms "optimize," "optimal" and the like as used herein can be used to mean making or achieving performance as effective or perfect as possible. However, as one of ordinary skill in the art reading this document will recognize, perfection cannot always be achieved. Accordingly, these terms can also encompass making or achieving performance as good or effective as possible or practical under the given circumstances, or making or achieving performance better than that which can be achieved with other settings or parameters.

At operation 264, the ultrasonic signal is caused to impinge on the intended listener. Depending on the carrier frequency, ultrasonic signals are typically considered to be highly directional. For example, signals in the 40 kHz-70 kHz range, or greater, are highly directional signals. Accordingly, in some embodiments the ultrasonic signal is directed at the listener, and more particularly, can be directed at the listener's ear. In further embodiments, such as where a Left and Right ultrasonic signal are generated, one signal can be directed toward one of the listener's ears and the other signal toward the other ear. Alternatively, both signals can be directed at either or both ears.

In some embodiments, the ultrasonic signal can be launched through the air and caused to impinge upon the listener's head to result in conduction of the signal to the cochlea as discussed below. In other embodiments, the ultrasonic signal is created at the skull by a transducer implanted at the skull in direct physical contact with the listener's head. In further embodiments, the transducer can be implanted subcutaneously so as to have direct physical contact to the listener's skull such as for example at the temporal bone, parietal bone, or the mastoid process.

At operation 266, upon reaching the listener, the ultrasonic wave travels to the listener's inner ear. For example, the ultrasonic wave propagates through the tympanic membrane and the three small bones, or ossicles to the inner ear, where the ultrasonic wave is demodulated in the inner ear. Alternatively, or additionally, the ultrasonic wave propagates through the bone structure surrounding the ear such as through the temporal bone or the mastoid process. The wave travels through the bones into the inner ear.

The ultrasonic wave impinging on the surface of the human head are absorbed by the soft tissue and bones of the head. The wave propagates through the bones to the inner ear. In some embodiments, movement of the otolith stones in the saccule of the inner ear or action of the cochlear aqueducts that contain perilymph fluid are the primary mechanisms of bone conduction, and the system is optimized accordingly.

At operation 268, the ultrasonic wave is demodulated in the inner ear and results in an energy wave representing the original audio signal (demodulated from the ultrasonic carrier) in the inner ear. In various embodiments, this wave travels through the perilymph fluid and stimulates movement of the basilar membrane resulting in displacement of the stereocilia. In other embodiments, the ultrasonic wave demodulates and results in an energy wave representing the original audio signal being generated in the endolymph fluid of the scala media, thereby resulting in movement of the stereocilia.

Figure 1:
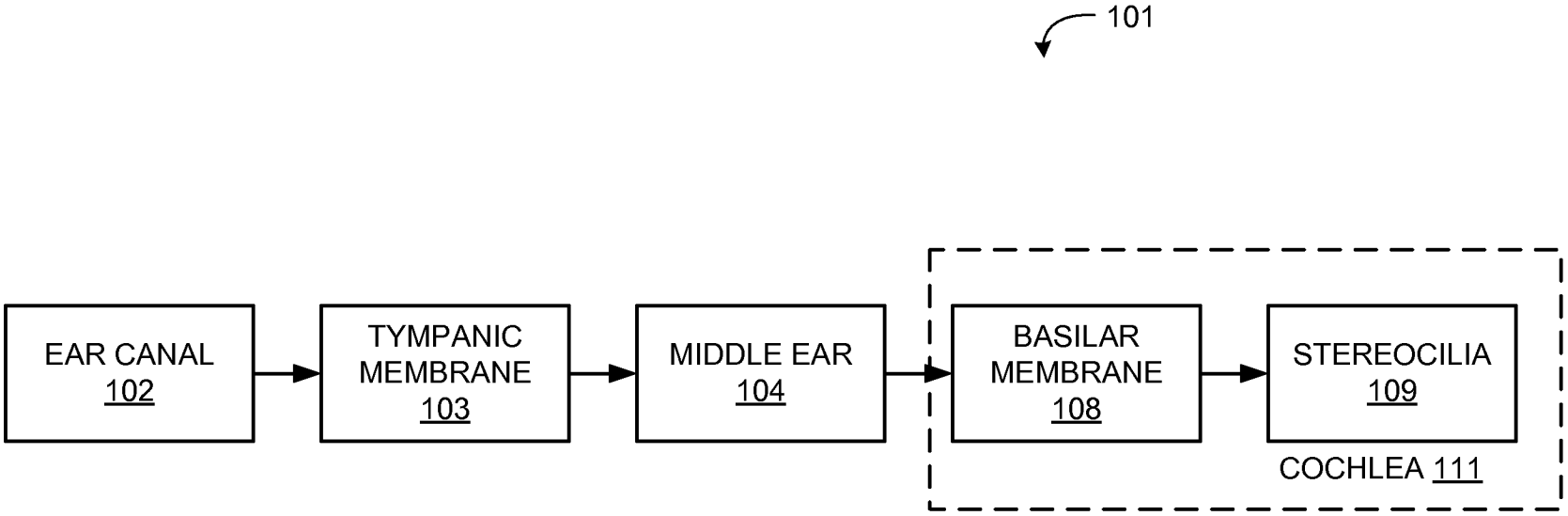
FIG. 1 is a block diagram generally representing the features of the mammalian ear.

In another embodiment, the audio signal is recovered in the ear canal 102 (FIG. 1). In such embodiments, the ultrasonic signal is demodulated in the air both in the ear canal and before reaching the ear canal, resulting in recovery of the original audio content. Accordingly, the resultant audio pressure wave causes vibration of the tympanic membrane much like a conventional audio signal.

As noted above, in some embodiments, one or more system parameters are optimized or adjusted to function for the improvement of the hearing of one or more intended listeners. For example, certain embodiments use carrier frequencies in the 30 kHz-60 kHz range, and more preferably in the 40 kHz-50 kHz range; while other embodiments use carrier frequencies in the 50 kHz-70 kHz. Still other embodiments use carrier frequencies above or below these ranges. In one embodiment, the carrier frequency is 44 kHz; in another embodiment, the carrier frequency is 60 kHz. In further embodiments, the carrier frequency is tuned to be tailored to or optimized for the targeted listener or group of listeners.

In some embodiments, the intended listener can be evaluated or tested to determine the listener's response profile and to tailor the system parameters to the listener's individual characteristics. While skull bone conduction characteristics generally do not vary widely from listener to listener, in some embodiments the conduction characteristics of a listener's head are determined to optimize or adjust the carrier frequency and signal levels to reproduce the ultrasonic signals in the cochlea. By way of further example, the ultrasonic frequency can be applied to the listener's head and the carrier frequency swept continuously or in steps through a predetermined range to determine the optimum frequency for that listener. The range may be from 20 kHz to 100 kHz in some embodiments. In other embodiments, the range can be from 35 kHz to 60 kHz. In still other embodiments, other ranges can be used. To determine the optimum carrier frequency, measurements can be made by, for example, using a detector at another point on the listener's head to determine the level of attenuation of the signal. In other embodiments, an audio signal can be modulated onto the swept carrier and the listener can provide feedback indicating frequencies or frequency ranges at which the listener hears the audio acceptably well.

In another embodiment, in addition to or in place of sweeping the carrier frequency, the placement of the actuator can be moved to different locations about the listener's head to determine the point at which hearing is optimized. Measurements can be made by, for example, using a detector at another point on the listener's head to determine the level of attenuation of the signal. In other embodiments, the listener can provide feedback indicating the frequency at which the listener hears the audio acceptably well.

In still further embodiments, hearing characteristics of a listener can be mapped and the audio system calibrated to deliver an audio signal tailored to the listener's hearing characteristics. For example, in some embodiments the listener can be given a hearing exam in which the listener is exposed to a plurality of different audio signals having different characteristics, and the listener's hearing response to those signals mapped and profiled. For example, audio tones can be generated for the user at different frequencies and levels and the listener's ability to hear different frequencies can be recorded. Particularly, the listener's hearing at each frequency can be evaluated to determine whether there are one or more frequency ranges the listener has difficulty hearing. Additionally, the amount or degree of hearing loss, or relative hearing disability, at each frequency or frequency range can be determined. Likewise, other metrics such as the listener's ability to detect dynamic range and to differentiate intended sound over background noise can be measured and recorded. In such a manner, a hearing profile can be developed for the listener mapping his or her ability to hear different frequencies or frequency ranges.

With this hearing profile information, the ultrasonic audio system can be adjusted to provide output audio levels complementary to the targeted listener's hearing profile. For example, the ultrasonic audio system can be adjusted or equalization applied to amplify frequency ranges that the hearing profile indicates the user has difficulty hearing. These can be one or more narrow or broad ranges, depending on the listener's hearing profile. Embodiments can be configured to provide audio content with a greater volume or sound pressure level at frequencies the listener has difficulty hearing relative to the levels it provides at other frequencies. In some embodiments, the volume increase at each frequency or frequency range is proportional to the amount of hearing loss suffered by the listener in each corresponding frequency or frequency range. The audio signal can be equalized before it is modulated onto the ultrasonic carrier, and the modulated carrier signal sent can be an equalized audio modulated ultrasonic carrier signal.

As an example, if the profiling indicates that a user requires an additional 3 dB SPL to hear audio frequencies above 4 kHz at normal listening volumes, the audio system can be adjusted to provide a 3 dB SPL increase for audio content above 4 kHz. As yet another example, assume the profiling indicates that a user has normal hearing up to 3.5 kHz, but his or her hearing increasingly drops off as a determined function of frequency above 3.5 kHz. In this example, the ultrasonic audio system can be adjusted to provide a corresponding increase in volume for frequencies above 3.5 kHz in accordance with the determined function of frequency. Accordingly, in these examples, the increase in amplification of the audio signals at given frequencies corresponds to the listener's hearing inabilities at those frequencies.

In some embodiments, the audio is adjusted per the profile on a pre-modulation basis. That is, the audio signal is simply equalized to the indicated levels before modulation. In the case of the example in which a listener requires an additional 3 dB SPL to hear audio frequencies above 4 kHz at normal listening volumes, the audio signal would be adjusted to provide the additional 3 dB SPL at those frequencies in the audio content prior to modulation.

In other embodiments, the audio is adjusted such that the audio signal demodulated in the air has the desired adjusted audio profile (e.g., the SPL is increased at a desired frequency or frequencies in the audio that is created in the air). This is because the ultrasonic signal processing system (e.g., signal processing system 10) and ultrasonic transducers (e.g., transducer 157) can alter the frequency characteristics of the resultant demodulated audio signal. For example, the ultrasonic signal processing system may boost certain frequency ranges, while decreasing others. Accordingly, in some embodiments, the demodulated audio signal is evaluated to determine the effective equalization applied by the signal processing system. This effective equalization is considered when applying equalization to the audio signal to arrive at the desired equalization level in the demodulated audio signal. This is described in terms of the example above in which a listener requires an additional 3 dB SPL to hear audio frequencies above 4 kHz at normal listening volumes. Assume as a furtherance of this example, that the ultrasonic signal processing system boosts the frequencies above 4 kHz by 1 dB. In this case, the equalization can be applied to the pre-modulated audio content to boost frequencies above 4 kHz by 2 dB. This results in a total increase of 3 dB for frequencies above 4 kHz. Similarly, where the ultrasonic signal processing system reduces the frequencies above 4 kHz by 1 dB, the equalization can be applied to the pre-modulated audio content to boost frequencies above 4 kHz by 4 dB. Other changes in equalization caused by the signal processing system can be measured and adjusted for by pre-modulation equalization to either remove effects of the signal processing system or create a demodulated audio signal that is the complement of the listener's hearing profile.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the disclosed technology. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the disclosed technology should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A method for providing audio content to the hearing impaired, the method comprising:

evaluating a hearing response profile of a listener to an audio modulated ultrasonic carrier signal;

receiving audio content from an audio source;

adjusting the audio content to generate equalized audio content based on the hearing response profile, the equalization being chosen to at least partially compensate for the listener's hearing based on the response profile;

modulating the equalized audio content onto an ultrasonic carrier signal to generate an equalized audio modulated ultrasonic carrier signal, and converting the equalized audio modulated ultrasonic carrier signal into an ultrasonic pressure wave representing the equalized audio modulated ultrasonic carrier signal; and wherein the ultrasonic pressure wave is demodulated in air, causing audio content representing the equalized audio content to be created, enabling the listener to hear and recognize the audio content.

2. The method according to claim 1, further comprising creating the hearing response profile of the listener to audio modulated ultrasonic carrier signals.

3. The method according to claim 2, wherein creating the hearing response profile comprises generating a plurality of audio tones using an ultrasonic audio system and recording the listener's response to the generated tones.

4. The method according to claim 1, wherein the hearing response profile indicates a frequency range at which the listener has a hearing disability and a quantified amount of hearing disability at that frequency range.

5. The method according to claim 4, wherein adjusting the audio content comprises adjusting the audio content to increase a pre-modulated energy level of the audio content at the indicated frequency range by the quantified amount.

6. The method according to claim 4, wherein adjusting the audio content comprises adjusting the audio content to increase the de-modulated sound pressure level of the audio content at the indicated frequency range by the quantified amount.

7. A method for providing audio content to the hearing impaired, the method comprising:

evaluating a hearing response profile of a listener to audio modulated ultrasonic carrier signals;

determining preferred ultrasonic signal parameters based on the listener's hearing response profile;

receiving audio content from an audio source;

adjusting the audio content using the preferred ultrasonic signal parameters based on the listener's hearing response profile;

modulating the adjusted audio content onto an ultrasonic carrier signal to generate an equalized audio modulated ultrasonic carrier signal, and converting the equalized audio modulated ultrasonic carrier signal into an ultrasonic pressure wave representing the equalized audio modulated ultrasonic carrier signal; and wherein the ultrasonic pressure wave is demodulated in air, causing audio representing the equalized audio content to be created, enabling the listener to hear and recognize the audio content.

8. The method according to claim 7, wherein evaluating the listener's hearing response profile comprises determining which ultrasonic frequency of a range of ultrasonic frequencies provides the listener with the most improved hearing and recognition of audio content conducted by an ultrasonic carrier.

9. The method according to claim 8, wherein the ultrasonic carrier is at a center frequency in a range of 40-50 kHz.

10. The method according to claim 8, wherein the ultrasonic carrier is at a center frequency in a range of 50-70 kHz.

11. The method according to claim 8, wherein the ultrasonic carrier is at a center frequency selected to optimize the listener's hearing of the audio resulting from the demodulation.

12. A method for providing audio content to the hearing impaired, the method comprising:

evaluating a response profile of a listener's head to ultrasonic signals;

determining preferred ultrasonic signal parameters based on the listener's response profile;

receiving from an audio source an electrical signal representing audio content;

modulating the audio content onto an ultrasonic carrier to create an audio-modulated ultrasonic signal;

amplifying the audio-modulated ultrasonic signal to create an amplified audio-modulated signal having the preferred ultrasonic signal parameters;

transforming the amplified audio-modulated ultrasonic signal into an ultrasonic pressure wave representing the audio-modulated ultrasonic signal; and causing the ultrasonic pressure wave to be directed toward the listener;

wherein the ultrasonic pressure wave is demodulated, causing audio content to be created, enabling the listener to hear and recognize the audio content as a result of the preferred ultrasonic signal parameters.

13. The method according to claim 12, wherein causing the ultrasonic pressure wave to be directed toward the listener comprises causing the ultrasonic pressure wave to contact the head of a listener; wherein the ultrasonic pressure wave upon contact with the listener is conducted through one or more bones of the listener to the listener's inner ear, and wherein the ultrasonic pressure wave is demodulated in the listener's inner ear thereby recovering an audio pressure wave in the inner ear, the recovered audio pressure wave representing the audio content.

14. The method according to claim 12, wherein determining preferred ultrasonic signal parameters based on the listener's response profile comprises determining a hearing profile for the listener and determining an equalization for the audio content that is complementary to the listener's hearing profile.

15. A hearing-enhancement device, comprising:

an ultrasonic audio system; the ultrasonic audio system comprising: an input port configured to receive an electronic signal representing audio content; a mixer coupled to the input port and configured to combine the audio signal with an ultrasonic carrier signal, thereby creating a modulated ultrasonic carrier signal; an amplifier having an input coupled to the mixer and an output, the amplifier configured to amplify the modulated ultrasonic carrier signal; and an ultrasonic transducer having an input communicatively coupled to the output of the amplifier and being configured to generate a pressure wave representing the amplified modulated ultrasonic carrier signal;

wherein a signal parameter of the ultrasonic audio system is configured based on a hearing response profile of an intended listener; and wherein the ultrasonic pressure wave is demodulated, causing audio content representing the audio content to be created, enabling the listener to hear and recognize the audio content as a result of the ultrasonic signal parameter configuration based on the listener's hearing response profile.

16. The hearing-enhancement device according to claim 15, wherein the listener's response profile is determined by determining which ultrasonic frequency of a range of ultrasonic frequencies provides the listener with the most improved hearing of audio content conducted by an ultrasonic carrier.

17. The hearing-enhancement device according to claim 15, wherein the listener's response profile is determined by determining placement of an actuator used to deliver the ultrasonic pressure wave to the listener.

18. The hearing-enhancement device according to claim 15, wherein the response profile of the intended listener comprises a hearing profile and wherein configuring a signal parameter of the ultrasonic audio system comprises equalizing the audio content in accordance with the listener's hearing profile.

19. The hearing-enhancement device according to claim 15, wherein the hearing-enhancement device comprises a hearing aid or an assistive listening device.

20. A method for providing audio content to the hearing impaired, the method comprising:

evaluating a response profile of a listener;

determining preferred ultrasonic signal parameters based on the listener's response profile;

configuring an ultrasonic audio system according to the determined ultrasonic signal parameters; and using the ultrasonic audio system to transform an audio signal into an ultrasonic pressure wave representing the audio signal;

wherein the ultrasonic pressure wave is demodulated, causing audio content representing the audio content to be created, enabling the listener to hear and recognize the audio content based on the configuration of the ultrasonic audio system.

21. The method according to claim 20, wherein determining preferred ultrasonic signal parameters based on the listener's response profile comprises determining which ultrasonic frequency of a range of ultrasonic frequencies provides the listener with the most improved hearing of audio content conducted by an ultrasonic carrier.

22. The method according to claim 20, wherein determining preferred ultrasonic signal parameters based on the listener's response profile comprises determining optimal placement of an actuator used to deliver the ultrasonic pressure wave to the listener.

23. The method according to claim 20, wherein the response profile of the listener comprises a hearing profile and wherein configuring the ultrasonic audio system comprises equalizing the audio content in accordance with the listener's hearing profile.

24. A method for providing audio content to the hearing impaired, the method comprising:

evaluating a response profile of a listener's head to audio modulated ultrasonic signals;

determining preferred ultrasonic signal parameters based on the listener's hearing response profile;

receiving from an audio source an electrical signal representing audio content;

modulating the audio content onto an ultrasonic carrier to generate an audio-modulated ultrasonic signal using the preferred ultrasonic signal parameters;

amplifying the audio-modulated ultrasonic signal to create an amplified audio-modulated signal;

transforming the amplified audio-modulated ultrasonic signal into an ultrasonic pressure wave representing the audio-modulated ultrasonic signal; and causing the ultrasonic pressure wave to contact the head of a listener; wherein the ultrasonic pressure wave upon contact with the listener is conducted through one or more bones of the listener to the listener's inner ear, and wherein the ultrasonic pressure wave is demodulated in the listener's inner ear thereby recovering an audio pressure wave in the inner ear, the recovered audio pressure wave representing the audio content;

wherein generation of the audio-modulated ultrasonic signal using preferred ultrasonic signal parameters based on the listener's hearing response profile enables the listener to hear and recognize the audio content.

25. The method according to claim 24, wherein determining preferred ultrasonic signal parameters based on the listener's response profile comprises determining which ultrasonic frequency of a range of ultrasonic frequencies provides the listener with the most improved hearing of audio content conducted by an ultrasonic carrier.

26. The method according to claim 24, wherein causing the ultrasonic pressure wave to contact the head of a listener comprises placing an ultrasonic actuator in contact with the listener's head and applying the amplified audio-modulated ultrasonic signal to the amplifier.

27. A method for providing audio content to the hearing impaired, the method comprising:

evaluating a hearing response profile of a listener to an audio modulated ultrasonic carrier signal;

receiving from an audio source an electrical signal representing audio content;

adjusting the audio content to generate equalized audio content based on the hearing response profile, the equalization being chosen to at least partially compensate for the listener's hearing based on the response profile;

modulating the equalized audio content onto an ultrasonic carrier to create an audio-modulated ultrasonic signal;

amplifying the audio-modulated ultrasonic signal;

transforming the amplified audio-modulated ultrasonic signal into an ultrasonic pressure wave representing the audio-modulated ultrasonic signal; and causing the ultrasonic pressure wave to contact the head of a listener; wherein the ultrasonic pressure wave upon contact with the listener is conducted through one or more bones of the listener to the listener's inner ear, and wherein the ultrasonic pressure wave is demodulated in the listener's inner ear thereby recovering an audio pressure wave in the inner ear, the recovered audio pressure wave representing the equalized audio content, which can be heard and recognized by the listener.

28. The method according to claim 27, wherein causing the ultrasonic pressure wave to contact the head of a listener comprises launching the pressure wave into the air in a direction toward the listener.

29. The method according to claim 27, wherein causing the ultrasonic pressure wave to contact the head of a listener comprises launching the pressure wave from an actuator placed in contact with the listener's head.

30. The method according to claim 27, wherein causing the ultrasonic pressure wave to contact the head of a listener comprises launching the pressure wave from an actuator placed in contact with the listener's skull subcutaneously.

31. The method according to claim 30, wherein the actuator is placed in contact with the listener's temporal bone, mastoid process or parietal bone.

32. The method according to claim 27, wherein the ultrasonic carrier is at a center frequency in a range of 40-50 kHz.

33. The method according to claim 27, wherein the ultrasonic carrier is at a center frequency in a range of 50-70 kHz.

34. The method according to claim 27, wherein the ultrasonic carrier is at a center frequency selected to optimize conduction of the carrier to the listener's inner ear.

35. A method for providing audio content to the hearing impaired, the method comprising:

evaluating a response profile of a listener's head to ultrasonic signals;

determining preferred ultrasonic signal parameters based on the listener's response profile;

receiving from an audio source an electrical signal representing audio content;

modulating the audio content onto an ultrasonic carrier to create an audio-modulated ultrasonic signal according to the preferred ultrasonic signal parameters;

amplifying the audio-modulated ultrasonic signal to create an amplified audio-modulated signal;

transforming the amplified audio-modulated ultrasonic signal into an ultrasonic pressure wave representing the audio-modulated ultrasonic signal; and causing the ultrasonic pressure wave to be directed toward the listener;

wherein the ultrasonic pressure wave is demodulated in air, causing audio content representing the audio content to be created, enabling the listener to hear and recognize the audio content.

36. The method according to claim 35, wherein causing the ultrasonic pressure wave to be directed toward the listener comprises causing the ultrasonic pressure wave to contact the head of a listener; wherein the ultrasonic pressure wave upon contact with the listener is conducted through one or more bones of the listener to the listener's inner ear, and wherein the ultrasonic pressure wave is demodulated in the listener's inner ear thereby recovering an audio pressure wave in the inner ear, the recovered audio pressure wave representing the audio content.

37. The method according to claim 35, wherein determining preferred ultrasonic signal parameters based on the listener's response profile comprises determining a hearing profile for the listener and determining an equalization for the audio content that is complementary to the listener's hearing profile.

* * * * *